United States Patent [19]

Horner

[11] Patent Number: 5,065,880

[45] Date of Patent: Nov. 19, 1991

[54] SPLASH RESISTANT CUP LID

[76] Inventor: Tom Horner, 3440 N. Beltline, No. 1066, Irving, Tex. 75062

[21] Appl. No.: 237,873

[22] Filed: Aug. 29, 1988

Related U.S. Application Data

[63] Continuation-in-part of Ser. No. 101.353, Sep. 25, 1987, Pat. No. 4,767,019.

[51] Int. Cl.[5] ..... A47G 19/22

[52] U.S. Cl. ..... 220/711; 229/906.1

[58] Field of Search ..... 220/90.4; 229/906.1

[56] References Cited

U.S. PATENT DOCUMENTS

| | | | |
|---|---|---|---|
| 3,860,162 | 1/1975 | Schutz | 220/90.4 X |
| 3,938,695 | 2/1976 | Ruff | 220/90.4 |
| 4,056,210 | 4/1977 | Boyle | 220/90.4 |
| 4,113,135 | 9/1978 | Yamazaki | 220/90.4 X |
| 4,331,255 | 5/1982 | Fournier | 220/90.4 X |
| 4,345,695 | 8/1982 | Galloway et al. | 220/90.4 X |
| 4,489,848 | 12/1984 | Braude | 220/90.4 |
| 4,582,214 | 4/1986 | Dart et al. | 220/90.4 |
| 4,619,372 | 10/1986 | McFarland | 220/90.4 |
| 4,767,019 | 9/1988 | Horner | 220/90.4 |

*Primary Examiner*—Steven M. Pollard

*Attorney, Agent, or Firm*—John W. Montgomery

[57] ABSTRACT

A spill resistant lid having a rim structure adapted to engage a lip around the mouth of a drinking container is a substantially leakproof manner comprising a canopy suspended across the rim structure; a vertical opening defined in the canopy; and selectively choosable sizes of the defined vertical opening to meter the flow rate of liquid through the vertical opening.

11 Claims, 1 Drawing Sheet

SPLASH RESISTANT CUP LID

This is a continuation-in-part of U.S. application Ser. No. 101,353, filed Sept. 25, 1987, now U.S. Pat. No. 4,767,019.

BACKGROUND OF THE INVENTION

The invention relates to a splash resistant cup lid and a method of making same and in particular to a lid of the type for use on disposable hot beverage cups or containers and a method for making a disposable cup lid which is suitable for vacuum forming.

Along with the proliferation of fast food restaurants and extensive public and private transportation such as air plane and automotive travel, has come the need for transporting potable beverages in single serving size containers which are portable, disposable, and spill resistant. Particularly annoying are spills and splashes caused by beverage sloshing resulting from the normal jostling associated with drinking beverages "on the run" as while walking, riding in public transportation, private automobiles or the like. Open top disposable containers or cups have to a great extent become common place and to a great extent standardized as to the inverted frusto conical form for hot and cold beverages. However, the cup lids for use with such containers vary greatly as to design and a completely suitable cup lid has yet to be developed.

Problems associated with cup lids for hot beverages are often distinct from those associated with cold beverages. For example, cup lids which have a centrally located straw opening have been found to be useful with cold beverage containers but are not suitable for hot beverages which are not easily consumed through a straw.

Most of the prior cup lid designs are complicated and expensive to manufacture. Many designs can only be used in conjunction with specially manufactured cups such that the cup and lid together form a reuseable assembly which must be cleaned between uses and is thus not easily adapted for fast food type beverage dispensing. Alternatively a cup lid which may be reuseable on standard size hot beverage containers might be partially suitable for fast food dispensing, but still is too expensive to be disposable and therefore must be cleaned after each use. Other designs, while potentially disposable, are difficult to make in a configuration suitable for nesting which, of course, permits economical shipment. Others simply do not act to sufficiently retard splashing or sufficiently reduce the spill rate while simultaneously permitting consumption through the lid.

The instant invention overcomes many of these drawbacks and provides an easily manufacturable, disposable, spill resistant, nestable, easily attachable cup lid through which a beverage, hot or cold, can be consumed. Further, the invention provides metered liquid flow and means for selecting a flow rate which is most convenient for the conditions of the drink and the preferred drinking speed of the consumer.

Moreover, the instant inventive cup lid can be manufactured according to the invention with a method suitable for mass production of nestable cup lids composed of coated paper, injection molded plastic, styrofoam, or vacuum formed plastic. In particular, preferred embodiments of the lid and the method of forming them relate to vacuum formed plastic cup lids.

SUMMARY OF THE INVENTION

Thus, the present invention is for a splash resistant lid for use on a beverage cup of the type having a mouth circumscribed by an upper lip from which the beverage can be consumed. The lid comprises a rim means for sealing engagement with the upper lip and extending downward into the mouth of the cup. A central cover means extends substantially horizontally from the downward extension of the rim means substantially closing the cup mouth such that an upper reservoir is formed in the cup a short distance below the lip. A depression means for defining a vertical opening in the cover such that liquid sloshed inside the cup and thus having a vertical motion toward the mouth of the cup will be deflected thereby resisting spillage. Imparting horizontal motion to the contained beverage as by tipping the cup to the users lips will cause the liquid to pass through the vertical opening in sufficient quantity for convenient consumption. The size of the opening can be selectively chosen by the consumer to provide a rate of beverage flow through the opening commensurate with the temperature or the viscosity or like condition of the beverage or with the preferred drinking speed of the individual consumer. Small openings can be selected for very hot drinks and low viscosity drinks or slow-drinking preferences. Large openings can be selected for cool drinks or for highly viscous drinks or fast-drinking preferences.

BRIEF DESCRIPTION OF THE DRAWINGS

The invention will be more fully understood from the Detailed Description which follows and with reference to the drawings of preferred embodiments in which.

DETAILED DESCRIPTION OF THE DRAWINGS

Figure 1:
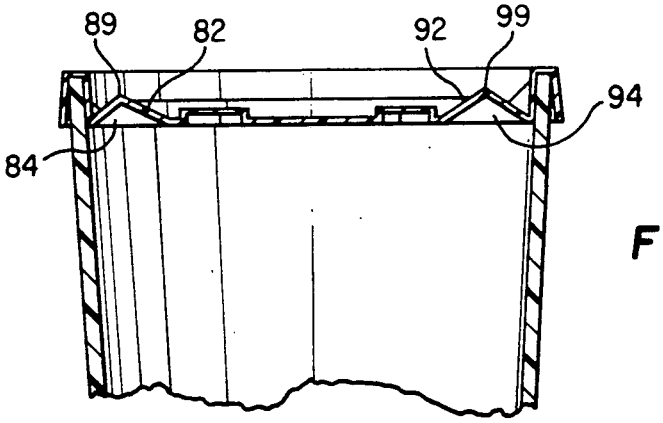
FIG. 1 is a partial section view of an embodiment of the inventive cup lid with selectable opening sizes.

FIG. 1 is a partial section view of a cup 10 showing one preferred embodiment of the cup lid generally designated 20 placed thereon. The cup is of the type having a mouth 12 circumscribed by an upper lip 14 from which a beverage contained within the walls 16 and bottom (not shown) of the cup can be consumed. A rim means 22 is provided for sealing engagement with said upper lip 14 and extends downward into said mouth 12 to a point 24 below said upper lip 14. The rim means also extends downward on the outside of the mouth to form an inverted U-shape for engaging the lip 14 in a liquid tight manner. A central cover means 30 extends substantially horizontally from said rim means 22 at said point 24 inside the cup below said upper lip 14 substantially closing said cup mouth 12 such that an upper reservoir 31 is formed in said cup mouth 12 below said lip 14 thereof. A depression means 82 is provided for defining at least one vertical opening 84 in said central cover means 30 adjacent to said rim means 22.

Figure 2:
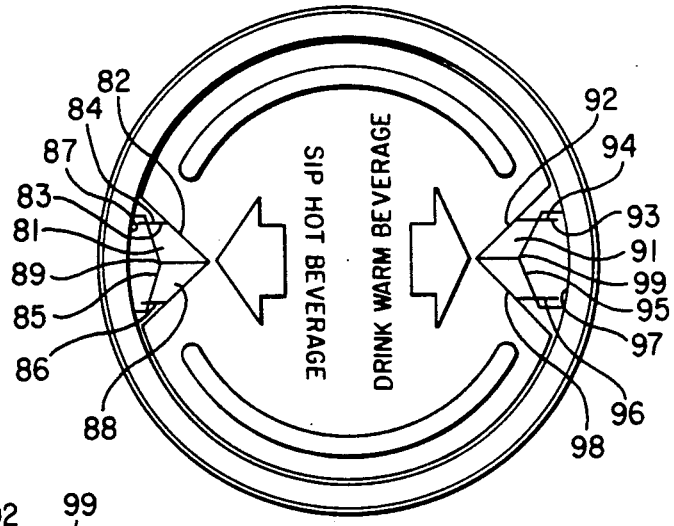
FIG. 2 is a top view of the embodiment of FIG. 1.

With reference to both FIG. 1 and FIG. 2, the details of construction of the inventive cup lid can be more fully understood. Throughout this application, a vertical opening shall be defined as one which is defined by edges of fluid impermeable material forming the perimeter of the vertical opening, all of which edges lie in a vertical plane with respect to the cup when the bottom of the cup is placed horizontally. Thus, for example, when depressed the lower edge portion 33 of depression means 82 lies in a vertical plane of the vertical opening 84 abutting the plane substantially perpendicular from one direction while upper edge portion 35, which is merely a raised portion of the central cover portion 30, also lies in the same vertical plane of the vertical opening. Thus, edge portion 33 and edge portion 35 approach said plane of the vertical opening 84 from the opposite perpendicular directions.

From, this construction, and with reference to FIG. 2, it can be understood that when viewing the cup lid from the top or the bottom with depression means 82 depressed, each vertical opening 84 or 94 appears as a short line 83 or 96 without substantial width. Thus, liquid having vertical motion with respect to the cup lid will impact upon fluid impermeable material thereby deflecting its vertical motion to prevent any splashing thereof from the top of the cup.

It will further be understood, however, that with respect to liquid having horizontal motion with respect to the cup lid as may be created by tilting the cup and lid assembly, liquid will pass through the openings 84 and 94.

The total area of the vertical opening is uniquely limited to meter the volume of liquid flow therethrough. Thus, the total vertical opening area will preferably be sized to permit the passage of a sufficient amount of liquid upon tipping the cup for convenient consumption. It has been found that a total vertical opening area of approximately 0.1 $cm^2$ (0.015 $in^2$) will provide sufficient volume flow for convenient consumption depending upon the consistency of the liquid involved. Thus, where there are two vertical openings each will have an area of approximately 0.05 $cm^2$ (about 0.007 $in^2$). Thicker liquids such as milkshakes, expresso, or creamy hot chocolate may require a larger total vertical opening area while soft drinks, coffee, or the like work well with the indicated size. It is particularly beneficial to meter the flow of hot drinks which are not only normally sipped but which can cause discomfort if they are inadvertently sloshed while sipping.

Referring again to FIGS. 1 and 2, means 80 for selectively choosing the size of the vertical opening are provided. More than one depression means 82 and 92 are provided spaced apart. As will be more fully explained below, the vertical opening 84 formable with depression means 82 is smaller than vertical opening 94 formable with depression means 92. In the preferred embodiment each depression means 82 and 92 can provide two vertical openings of substantially equal size with vertical openings 84 and 86 being smaller, if selected, than vertical openings 94 and 96 if they are selected. Thus, if the drink is at a high temperature (i.e.. "sipping hot") then depression means 82 is selected and depressed to form small vertical openings 84 and 86 for metered flow adequate for sipping. As the drink cools or if it is served at a lower temperature, depression means 92 can be selected and depressed to form vertical larger openings 94 and 96 to permit metered flow adequate for drinking rather than merely sipping.

While it will be understood that a single depression means defining a single vertical opening could be used (not shown), it has been found to be advantageous to have two vertical openings 84 and 86 formed as shown in FIGS. 1 and 2. Alternatively, multiple vertical openings defined by multiple depression means could be used.

Referring again to FIG. 2, it is important that a leak proof seal be achieved between rim 22 and cup lip 14. This can be accomplished in the conventional manner, as shown, in which a rim with an inverted, U-shaped cross-section clamps over both sides of the cup lip 14. It should be noted that both the inside and the outside ends of the U-shaped cross-section angle away from each other so that nesting or stacking is permitted. Alternatively, other leak proof rim engagement means may be used consistent with the present invention. For example, where rim portion 28 is manufactured at a slight angle for press fit engagement with interior wall 16 of cup 10, a sufficient seal may be created without a U-shaped engagement. Preferably, the cup lids can be formed with rim 28 having a frusto-conical shape corresponding to standard frusto-conical shaped cups. In the case of a styrofoam cup 10 and a thermal setting plastic cup lid 20, the styrofoam and/or plastic lid will easily accommodate and deform slightly, if necessary, to conforming shapes for a liquid tight sealing engagement.

Figure 3:
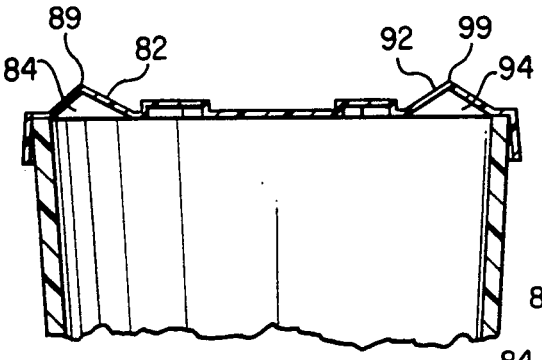
FIG. 3 is a section view of another alternative embodiment of the invention cup lid.
Figure 4:
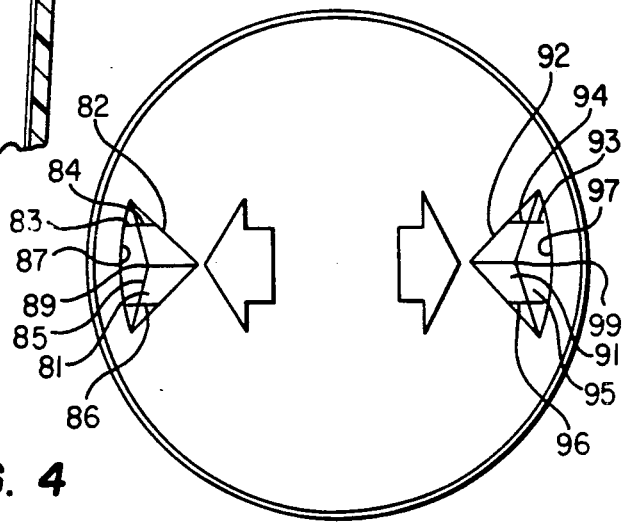
FIG. 4 is a top view of the embodiment of FIG. 3.

It has been found that the depth of the reservoir formed by rim portion 28 and central closure portion 30 should preferably be sufficient to permit convenient drinking. A depth of approximately 1 cm can be advantageously used. The range, of course, may vary; however, it has been found that by providing a reservoir which is too deep, the capacity of the cup is reduced and cup lid material is wasted and by providing a reservoir which is too shallow convenient, comfortable consumption may be impeded. Nevertheless, some of the spill resistant advantages obtained by using vertical openings and some of the advantages obtained using means for selecting different metered flow rates can be achieved even where the cup lid is formed without any reservoir as shown in FIGS. 3 and 4. The consumer would simply place his or her mouth directly over the depression means 89 or 99 and drink straight through the vertical openings formed in the canopy of the lid.

In the embodiment of a cup lid, according to the present invention in FIGS. 3 and 4, a raised portion 82 is formed upwardly from the central cover portion 30 again adjacent one portion of rim wall 28. The raised portion 82, when made in a thermal setting plastic, becomes slightly thinner than the rest of the central cover means 30 and therefore slightly more flexible. Separation means 83 and 86 are formed as by a sharp blade used to make cuts at both ends of raised portion 82. The cuts extend down to the central cover portion 30. The cup lid is then in a condition for nesting or stacking of lids, one on top of another, and for easy transportation and storage. The cup lids can then be placed upon beverage containers for delivery to consumers in a completely sealed non-spill condition. When the beverage is to be consumed, the central portion of raised portion 82 is pushed downward to form a depression 81, which together with raised end portions comprise depression means 82 which defines vertical openings 84. As the raised portion 82 is more flexible than the surrounding central closure material 30 and as the cuts 83 and 86 are easily separable from the raised end portions, the material forming depression 81 merely pops over center and remains in the downwardly depressed condition thereby maintaining vertical openings 84 for easy consumption. It can be advantageous to provide additional flexibility through ridges 85. These ridges act much like an accordian to allow the raised portion to "pop" over center to become depression 81 and vice versa. The depressed middle portion 81 could also be manually pushed back into a substantially closed upward position.

In the specific embodiment as shown in FIGS. 1–4, and a depression means 82 comprises a raised tetrahedral shaped portion 88 having its apex 89 above the plane of the canopy. A cut 83 or separation means is made vertically through said raised tetrahedral shape to form vertical opening 84. The size of the vertical opening can be determined during manufacturing. For example, the size of the tetrahedral shaped portion is controlled and/or the position of the cut on the tetrahedral shaped portion is controlled. The opening will be larger if the cut is closer to the apex 89 of the tetrahedral shaped portion 88. Where two vertical openings are used in a preferred embodiment both will preferably be an equal distance from the apex 89 of a bilaterally symetrical tetrahedral shaped portion 88 with the size of raised portion 88 adequate to provide a large enough depressible part 81 such that it can easily be depressed by the consumer using his or her finger and still maintain a total opening area for "sipping" metered flow. For maximum ability to empty the cup one base "line" 87 of said tetrahedral shape is arc shaped and corresponds to the curve of the rim or interior cup wall. The cuts are made substantially perpendicular to a tangent to said arc. For the strength the ridges 85 of the tetrahedral can be radiused so that when the depressible part 81 is depressed and "pops" over center, cracking will be avoided.

Preferably, the configuration for depression means 92 is similar to that for depression means 82. To obtain an increased flow rate, either the tetrahedral shaped raised portion can be formed larger with the cuts made the same distance from apex 99 as with depression 82 above, or the cuts can be moved inwardly with respect to the apex 99.

In an alternative embodiment of the invention, multiple depressions are provided defining multiple vertical openings. In contrast to the vertical openings in FIGS. 1, 2 and 3, which were in a vertical plane extending substantially radially from the center of the cup, the planes of the vertical openings can also be formed are substantially perpendicular to radial lines from the center of the cup.

Again, the multiple vertical openings will appear, from the top, as short lines and the combined or total opening area will be sufficient for convenient consumption. Also the separation between the openings can be varied to provide a greater or lesser range of positioning of the cup for convenient consumption. It has been found that vertical openings which are approximately 1.5 cm (0.7 in) apart work well. While the shape of the depression or the raised portion from which the depression is made to obtain vertical openings has been described with particularity for various embodiments, it will be noted that other shapes can be used.

Heretofore, a method of conveniently forming vertical openings in vacuum formed plastic cup lids has been unknown. The present invention provides such a procedure adaptable for presently known vacuum forming technology as described above. It will also be recognized that the previously defined embodiments of the cup lid can be accomplished using materials and methods other than vacuum forming of plastics, for example, coated paper cup lids can be easily manufactured according to applicant's invention by slicing the paper at the precise location of the intended vertical opening and then forming depressions downwardly therefrom using steam heat and pressing forms with precise alignment as is known in the coated paper forming art.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A spill resistant lid having a rim structure adapted to engage a lip around the mouth of a drinking container in a substantially leak proof manner comprising:

(a) a canopy suspended from said rim structure;

(b) means for defining a vertical opening in said canopy including:

(i) a raised portion formed in said canopy; and (ii) separation means formed in said raised portion so that a first part of said raised portion can be depressed over center to a position below said raised portion to create and maintain said defined vertical opening between a second non depressed part of the raised portion and said first depressed part of said raised portion.

2. A cup lid as in claim 1 wherein said means for defining a vertical opening further comprises:

(a) two spaced apart raised portions in said canopy formed adjacent said rim structure; and (b) a separation means extending vertically through each of said raised portions such that a part of either one of said raised portions can be depressed to form a vertical opening in each of said two raised portions which vertical opening has a different size for each of said raised portions.

3. A cup lid as in claim 1 wherein said separation means extends substantially perpendicular to said lip of said cup and terminates at one end immediately adjacent said lip so that substantially all of a beverage in said cup can be consumed through said chosen vertical opening when said cup is tipped.

4. A cup lid as in claim 1 wherein:

(a) said raised portion is bilaterally symmetrical about a radius of said cup lid; and (b) said separation means comprises two spaced apart separation means through said raised portion.

5. A cup lid as in claim 1 wherein said separation means comprises a short horizontal cut through said raised portion such that upon depressing one part of said raised portion it becomes vertically separated along said cut to define said vertical opening through said canopy.

6. A spill resistant lid having a rim structure adapted to engage a lip around the mouth of a drinking container in a substantially leakproof manner comprising:

a. a canopy suspended from said rim structure for forming a shallow reservoir sized to fit into said mouth of said container; and b. means for defining a vertical opening in said canopy, said means for defining a vertical opening further comprising a tetrahedral shaped raised portion having an apex raised above said canopy and one base forming an arc at said rim with parallel vertical cuts through said raised portion and substantially radially inward from said arc shaped base portion, each cut a spaced apart distance from the other and equidistant from said apex.

7. A cup lid as in claim 6 wherein the corners of said tetrahedral shaped raised portion are supported with cup lid material extending from said rim such that said cuts are supported when said apex of said tetrahedral shape is depressed.

8. A cup lid as in claim 1 wherein the size of said defined vertical opening is pre-selected during manufacture by choosing a larger or smaller raised portion and by choosing longer or shorter separation means in said raised portions to meter the flow rate of liquid through said vertical opening according to the nature and thickness of the beverage to be consumed through said vertical opening.

9. A spill resistant lid having a rim structure adapted to engage a lip around the mouth of a drinking container in a substantially leak proof manner comprising:

(a) a canopy suspended from said rim structure over the mouth of said container; and (b) means for defining a vertical opening in said canopy, said means for defining a vertical opening further comprising a raised portion having a high point above said canopy and one base forming an arc at said rim with spaced apart vertical cuts through said raised portion and generally radially inward from said arc shaped base portion, each cut a spaced apart distance from the other and equidistance from the high point of said raised portion, so that a first part of said raised portion can be depressed over center to a position below said raised portion to create and maintain said defined vertical opening between a second non depressed part of the raised portion and said first depressed part of said raised portion.

10. A spill resistant lid as in claim 9 wherein said raised portion further comprises a tetrahedral shaped raised portion.

11. A cup lid as in claim 9 wherein either end of the base forming an arc at said rim is supported with cup lid material extending from said rim such that said cuts are supported when the high point of said raised portion is depressed.

* * * * *